US011731814B2

(12) United States Patent
Saito et al.

(10) Patent No.: US 11,731,814 B2
(45) Date of Patent: Aug. 22, 2023

(54) HINGE CAP AND HINGE CAP SET

(71) Applicant: KABUSHIKI KAISHA SHOFU, Kyoto (JP)

(72) Inventors: Takahiro Saito, Toyama (JP); Hiroaki Takashima, Toyama (JP); Naoya Kitada, Kyoto (JP); Rei Nishimura, Kyoto (JP); Hiroyuki Kobayashi, Kyoto (JP)

(73) Assignee: KABUSHIKI KAISHA SHOFU, Kyoto (JP)

( * ) Notice: Subject to any disclaimer, the term of this patent is extended or adjusted under 35 U.S.C. 154(b) by 0 days.

(21) Appl. No.: 17/568,230

(22) Filed: Jan. 4, 2022

(65) Prior Publication Data

US 2022/0212844 A1 Jul. 7, 2022

(30) Foreign Application Priority Data

Jan. 6, 2021 (JP) ..... 2021-000784

(51) Int. Cl.
*B65D 47/08* (2006.01)
*B65D 51/18* (2006.01)

(52) U.S. Cl.
CPC ..... *B65D 47/0809* (2013.01); *B65D 51/18* (2013.01); *B65D 2251/0025* (2013.01); *B65D 2251/105* (2013.01)

(58) Field of Classification Search
CPC ..... B65D 47/0809; B65D 2251/0025; B65D 2251/105
USPC ..... 215/235, 237; 222/556
See application file for complete search history.

(56) References Cited

U.S. PATENT DOCUMENTS 2,249,832 A * 7/1941 Hubschman ..... B65D 47/18 401/262
4,739,906 A * 4/1988 LoTurco ..... B65D 47/2081 222/484
4,826,026 A * 5/1989 Gach ..... B65D 47/0885 215/206

(Continued)

FOREIGN PATENT DOCUMENTS

JP 2006-61739 3/2006
JP 2011-111177 6/2011

(Continued)

OTHER PUBLICATIONS

Extended European Search Report dated May 12, 2022 in corresponding European Patent Application No. 22150104.2.

*Primary Examiner* — James N Smalley
(74) *Attorney, Agent, or Firm* — Wenderoth, Lind & Ponack, L.L.P.

(57) ABSTRACT

A hinge cap formed by an injection-molding comprises an inner lid capable of being attached to a container body, a hinge, and an outer lid that is connected to the inner lid by the hinge to open and close the cap. The inner lid includes a claw portion. The outer lid includes a tubular outer wall portion and a plurality of convex portions as undercut portions and a plurality of concave portions. One convex portion and a concave portion adjacent to the one convex portion form an engaging portion capable of being engaged with the claw portion. An adjacent convex portion adjacent to the engaging portion and a concave portion adjacent to the adjacent convex portion form a mold pressing portion.

6 Claims, 5 Drawing Sheets

(56) References Cited

U.S. PATENT DOCUMENTS

| | | | | | |
|---|---|---|---|---|---|
| 4,838,441 | A | * | 6/1989 | Chernack | B65D 47/0838 222/153.1 |
| 5,207,657 | A | * | 5/1993 | Gibilisco | A61M 35/003 222/546 |
| 5,246,145 | A | * | 9/1993 | Leoncavallo | B65D 47/18 222/542 |
| 5,501,348 | A | * | 3/1996 | Takeuchi | B65D 47/0828 220/827 |
| 5,996,859 | A | * | 12/1999 | Beck | B65D 47/0809 215/237 |
| 6,050,434 | A | * | 4/2000 | McNab | B65D 47/0809 220/838 |
| 2012/0248129 | A1 | | 10/2012 | Yoshida et al. | |

FOREIGN PATENT DOCUMENTS

| | | |
|---|---|---|
| JP | 2011-246137 | 12/2011 |
| JP | 5992221 | 9/2016 |
| JP | 2017-128338 | 7/2017 |
| WO | 2011/062211 | 5/2011 |

* cited by examiner

HINGE CAP AND HINGE CAP SET

BACKGROUND OF THE INVENTION

Field of the Invention

The present invention relates to a hinge cap including an inner lid attached to a container body, a hinge, and an outer lid connected to the inner lid to open and close the cap. The present invention also relates to a hinge cap set including a hinge cap and a packing sheet that is supported inside the hinge cap to enhance the airtightness of the inner lid in the closed state.

Description of the Related Art

The conventional hinge cap includes a cap body attached to a container body, a hinge portion, and a sealing portion connected to the cap body to open and close the container body (Japan Patent Laid-open Publication No. 2011-246137 A). This hinge cap is configured such that a closed state of the hinge cap is held by engaging a locking portion formed on the cap body and a claw portion formed on the sealing portion.

The claw portion is formed by a concave portion and a convex portion formed on an inner surface of a tubular object. In addition, the claw portion is formed on an opposite side of the hinge portion in the circumferential direction of the tubular object. The convex portion of the claw portion is an undercut portion that becomes a mold release resistance when releasing the claw portion from a mold in injection molding.

The terms used in the conventional hinge cap, such as the cap body, the sealing portion, the locking portion, and a portion facing the claw portion are referred to, in the present disclosure, as an inner lid, an outer lid, a claw portion, and an engaging portion, respectively.

SUMMARY OF THE INVENTION

For removing the molded piece with an undercut portion from the mold of the injection molding, 1) a forcible removal from a mold and 2) a slide core in the mold are known.

The mold using the technique 2) is more complicated and more expensive than the mold using the technique 1).

In the case of the technique 1), when performing forcible removal, the undercut portion is sometimes partially chipped or damaged so that the shape as designed may be deformed to an undesirable shape. In addition, if the engaging portion is formed on the opposite side of the hinge, that is, on a part in the circumferential direction of the tubular object, the mold release resistance is concentrated on the undercut portion of the engaging portion during mold release, and the undercut portion may be easily damaged. If the undercut portion is damaged, the closed state of the hinge cap becomes unstable.

The present invention has been created in consideration of the above circumstances, and an object thereof is to provide a hinge cap that makes an engaging portion (an undercut portion), which is a portion of an inner surface of a tubular object that contributes to the stability of a closed state of the hinge cap, less likely to be damaged during mold release in injection molding and stabilizes an engaging state. Another object of the present invention is to provide a hinge cap set capable of improving airtightness using this hinge cap.

The present invention presumes an injection-molded hinge cap including: an inner lid attached to a container body; a hinge; and an outer lid connected to the inner lid by the hinge to open and close the cap.

The inner lid includes: a tubular inner wall portion that is attached to a mouth portion of the container body; an inner closing plate portion which protrudes from an inner surface of the inner wall portion in a state of closing the inner side thereof and in which a passage port for contents is formed; and a claw portion that protrudes outward in a radial direction from a surface of the inner closing plate portion.

The outer lid includes: an outer wall portion having a tubular configuration; an outer closing plate portion protruding from an inner surface of the outer wall portion in a state of closing the inside thereof; and a plurality of convex portions, as undercut portions, and a plurality of concave portions which are arranged side by side in an axial direction on the inner surface of the outer wall portion.

One convex portion and a concave portion adjacent to the one convex portion on an inner side of the outer wall portion form an engaging portion which fits to the claw portion in a closed state of the outer lid. A convex portion adjacent to the engaging portion in the axial direction of the outer wall portion (at least one side of the inner side and an open end side) and a concave portion adjacent to the adjacent convex portion on the inner side of the outer wall portion form a mold pressing portion.

The engaging portion may include any convex portion of the plurality of convex portions. However, if another convex portion is arranged on the open end side of the outer lid with respect to the engaging portion, the claw portion is likely to come into contact with the another convex portion in an opening/closing operation of the outer lid. The contact corresponds a case where the claw portion is located on a locus of the another convex portion during the opening/closing operation of the outer lid. In such a case, it is difficult to open or close the outer lid unless the claw portion gets over not only the convex portion of the engaging portion but also the another convex portion during the opening/closing operation of the outer lid. In order to enable the outer lid to be opened or closed only by causing the claw portion to get over one convex portion, the following configuration is desirably adopted.

That is, the engaging portion includes a convex portion on the most open end side among the plurality of convex portions. If the engaging portion includes the convex portion on the most open end side, the mold pressing portion is adjacent to the engaging portion on the inner side of the outer wall portion.

In addition, a row formed by the concave portions and the convex portions of the engaging portion and the mold pressing portion is not limited in number and position with respect to a circumferential direction of the outer wall portion, but the following configuration is desirably adopted when considering the ease of opening and closing the outer lid, the ease of releasing a mold, and the stability of the outer lid in the closed state.

That is, the number of the rows formed by the concave portions and the convex portions of the engaging portion and the mold pressing portion is one with respect to the circumferential direction of the outer wall portion, and the row is formed on the opposite side of the hinge.

The outer wall portion may or may not include through-holes formed on both sides of the outer wall portion in the circumferential direction with respect to the engaging portion, but the following configuration is desirably adopted in order to stabilize an engaging state between the claw portion and the engaging portion while facilitating the opening/closing operation.

That is, the outer wall portion has the through-holes formed on both the sides of the outer wall portion in the circumferential direction with respect to the engaging portion.

The through-hole may have any shape, but the following configuration is desirably adopted in order to facilitate the opening/closing operation of the outer lid.

That is, the through-hole is an elongated hole extending in the axial direction of the outer wall portion.

In the hinge cap, the passage port for the contents may adopt any configuration. The hinge cap may be used alone or used in combination with other parts. However, a hinge cap set in which the hinge cap and a packing sheet are combined desirably adopts the following configuration in order to improve airtightness in a closed state.

That is, the hinge cap set includes the hinge cap and the packing sheet that enhances the airtightness in the closed state of the hinge cap. The inner closing plate portion includes: an inner closing plate body protruding inward in the radial direction from the inner surface of the inner wall portion over the whole circumference in a circumferential direction; and a nozzle serving as the passage port for the contents, which is formed on an inner peripheral portion of the inner closing plate body, and protruding from the inner peripheral portion of the inner closing plate body to the opposite side of the container body. The outer lid includes a packing sheet support portion inside. The packing sheet has elasticity to be recessed in a state of being in close contact with a distal end of the nozzle.

Note that opening force acts on the outer lid due to restoring force of the packing sheet, and thus, the outer lid is likely to be opened by the restoring force of the packing sheet, for example, unless engaging force between the claw portion and the engaging portion is stronger than that in a hinge cap without the packing sheet. In order to strengthen the engaging force such that the outer lid is not opened by the restoring force of the packing sheet, for example, it is necessary to make a dimension in the radial direction in the engaging state between the claw portion and the engaging portion larger than that in the hinge cap without the packing sheet. Even with such a configuration, a shape of the engaging portion can be brought closer to a shape as designed by the plurality of undercut portions configured to disperse a mold release resistance, and thus, the hinge cap stabilizes the engaging state between the claw portion and the engaging portion, and the packing sheet improves the airtightness.

A modification of an embodiment of the invention has the following structure.

A hinge cap with a body formed by an injection-molding comprises: a body having an open end with a claw portion provided on a rim of the open end; a hinge provided on the rim at a position opposite to the claw portion; and a lid connected to the body through the hinge to open and close the open end of the body. The lid includes: a tubular outer wall portion; an outer closing plate portion for closing one side of the outer wall portion; and a plurality of convex portions as undercut portions and a plurality of concave portions which are aligned alternately in an axial direction of the tubular outer wall portion on an inner surface of the outer wall portion, one convex portion and a concave portion adjacent to the one convex portion form an engaging portion capable of being engaged with the claw portion in a closed state of the outer lid, and an adjacent convex portion adjacent to the engaging portion and a concave portion adjacent to the adjacent convex portion form a mold pressing portion.

In the hinge cap of the present invention, the plurality of convex portions as the undercut portions are arranged side by side in a straight line in the axial direction of the tubular outer wall portion. Thus, the mold release resistance when the outer wall portion is released from the portion of the injection-molding mold that forms the inner surface of the outer wall portion is dispersed to the plurality of undercut portions, and the shape of the engaging portion can be brought closer to a shape as designed, and an engaging state between the engaging portion and the claw portion is stable as compared with, for example, a hinge cap in which one convex portion as an undercut portion is arranged on the outer wall portion.

In the hinge cap of the present invention, the claw portion does not have to get over another convex portion during the opening/closing operation of the outer lid when the engaging portion includes the convex portion on the most open end side among the plurality of convex portions so that the opening/closing operation becomes easy.

In the hinge cap of the present invention, in a case where the row formed by the concave portions and the convex portions of the engaging portion and the mold pressing portion with respect to the circumferential direction of the outer wall portion is single and formed on the opposite side of the hinge, the outer lid can be easily opened and closed and the mold can be easily removed during injection molding as compared with a case where there are a plurality of the rows, and the closed state of the outer lid is more stable than that in a case where the row is formed in the vicinity of the hinge.

In the hinge cap of the present invention, the outer wall portion is easily deformed elastically by the amount of the through-hole when the through-holes are formed on both the sides of the outer wall portion in the circumferential direction with respect to the engaging portion. Thus, the opening/closing operation of the outer lid becomes easy, and the shape of the outer lid does not change by the presence or absence of the through-hole unless external force is applied, so that the engaging state between the claw portion and the engaging portion is stable.

In the hinge cap of the present invention, the opening/closing operation of the outer lid becomes easy when the through-hole is the elongated hole extending in the axial direction of the outer wall portion.

In the hinge cap set of the present invention, the shape of the engaging portion can be brought closer to the shape as designed by the plurality of undercut portions configured to disperse the mold release resistance, and thus, the engaging state between the claw portion and the mating portion can be held even if the packing sheet has the restoring force, and the airtightness is improved by the close contact between the packing sheet and the nozzle.

BRIEF DESCRIPTION OF THE DRAWINGS

FIG. 10 is an enlarged view of a portion 10 shown in FIG. 1B.

DESCRIPTION OF THE PREFERRED EMBODIMENT

Figure 1A:
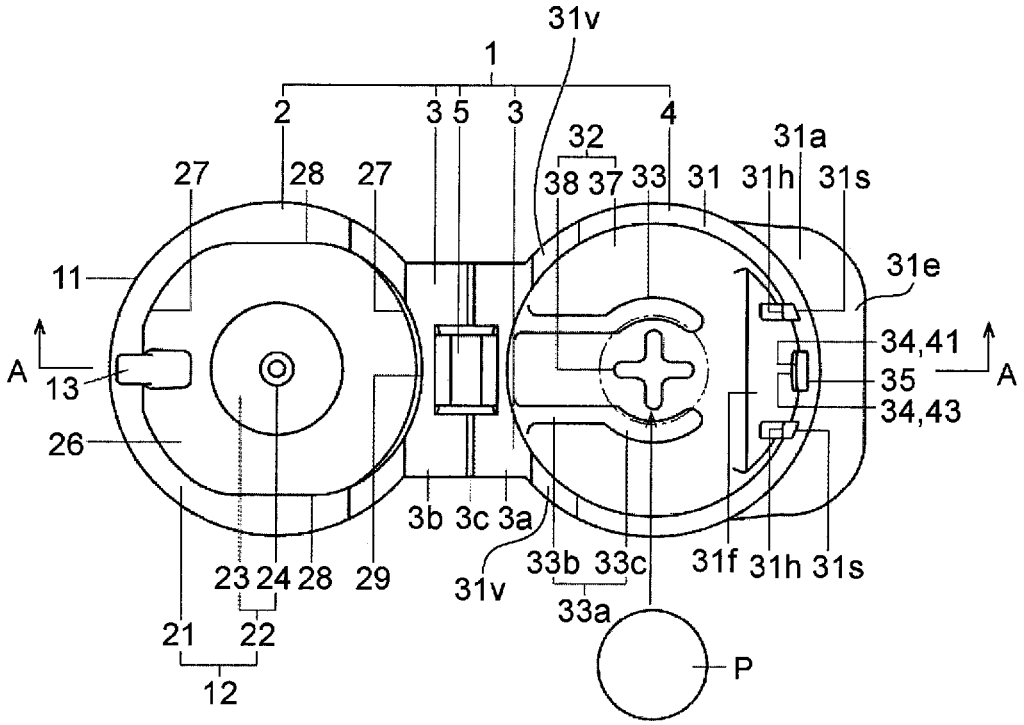
FIG. 1A is a top plan view of a hinge cap according to a first embodiment of the present invention formed by an injection-molding.
Figure 1B:
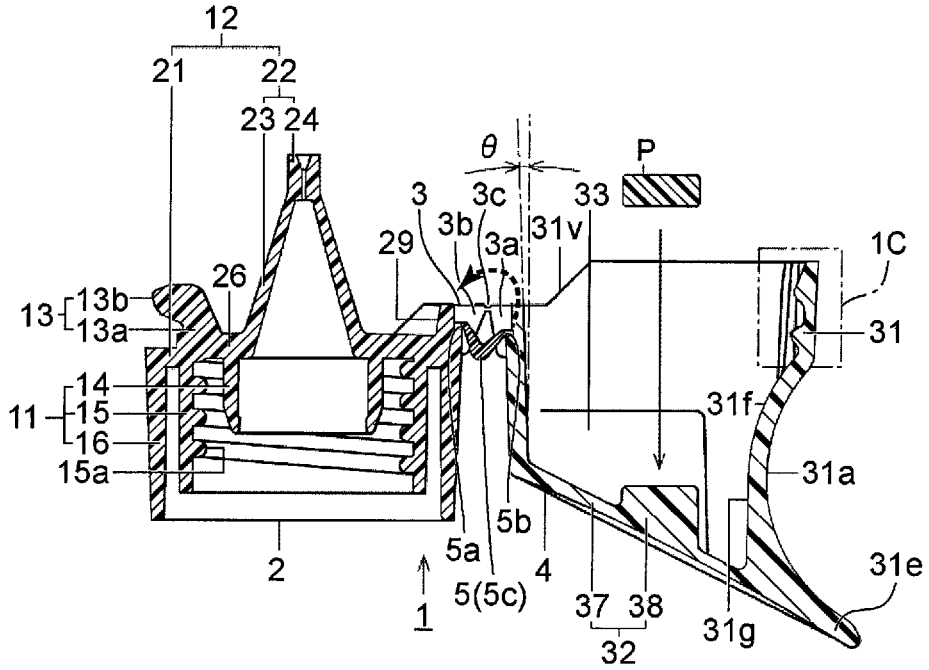
FIG. 1B is a cross-sectional view taken along a line A-A shown in FIG. 1A.
Figure 3:
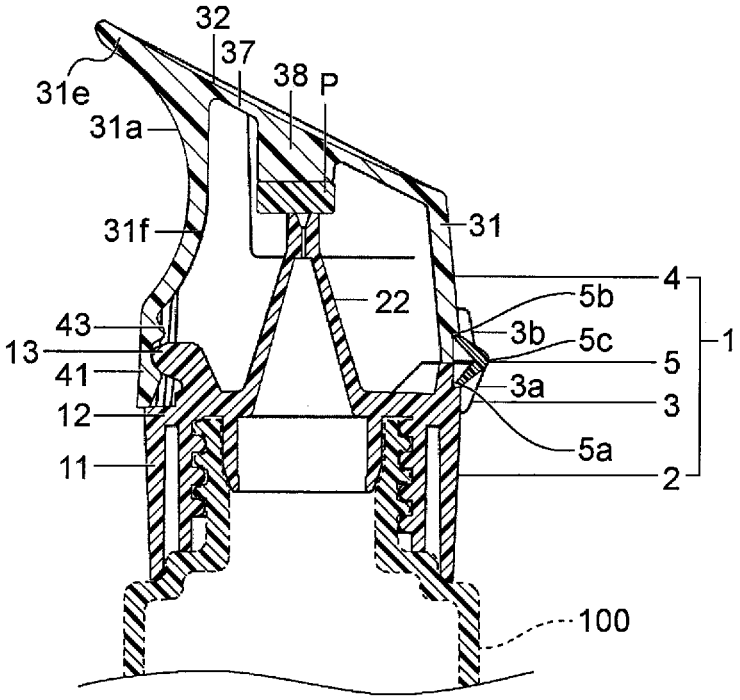
FIG. 3 is a cross-sectional view showing a closed state of the hinge cap to which the packing sheet is attached.

A hinge cap set of a first embodiment of the present invention shown in FIGS. 1A, 1B, and 10 includes: a hinge cap 1 attached to a container body 100 shown by the dotted line in FIG. 3; and a packing sheet P that enhances airtightness in a closed state of the hinge cap 1 and is supported inside the hinge cap 1.

The hinge cap 1 includes: an inner lid 2 attached to the container body 100; two hinged wings 3; an outer lid 4 that is connected to the inner lid 2 by the two hinged wings 3 to open and close the cap; and an L-shaped elastic plate 5 that applies opening force and closing force between the inner lid 2 and the outer lid 4. The hinge cap 1 is made of resin and is formed by an injection-molding, and the inner lid 2, the hinge 3, the outer lid 4, and the elastic plate 5 are configured as an integrated object. An axis of the container body 100, an axis of the inner lid 2, and an axis of the outer lid 4 are common in a state in which the container body 100 is assembled with the inner lid 2 and the outer lid 4 is closed by the inner lid 2.

The inner lid 2 includes: a tubular inner wall portion 11 attached to a mouth portion of the container body; an inner closing plate portion 12 having a nozzle 22 protruding from a top surface thereof; and a claw portion 13 protruding outward in a radial direction from the top surface of the inner closing plate portion 12.

Hereinafter, the hinge cap 1 is assumed to be in a state immediately after injection molding. The state immediately after injection molding is a state in which the outer lid 4 is open and the outer lid 4 is arranged on the right side of the inner lid 2 as shown in FIGS. 1A and 1B.

Directions are defined as follows except for the above-described left-right direction.

A "container body side" is referred to as the lower side of an object (for example, the inner closing plate portion 12) in FIG. 1B. An "opposite side of the container body" is referred to as the upper side in FIG. 1B.

An "axial direction" of a tubular object is referred to as an up-down direction in FIG. 1B in the case of the inner wall portion 11.

A "front-back direction" is referred to as a direction orthogonal to both the up-down direction and the left-right direction.

The "radial direction" is referred to as a direction of a straight line that extends radially from a center of a tubular object in a direction perpendicular to the axial direction.

As shown in FIG. 1B, the inner wall portion 11 extends towards the container body side from the inner closing plate portion 12. In addition, the inner wall portion 11 includes first, second, and third inner wall portions 14, 15, and 16 arranged in said order with intervals in the radial direction. The first, second, and third inner wall portions 14, 15, and 16 are each tubular, more specifically cylindrical, and have a common centerline. That is, the inner wall portions 14, 15 and 16 have a common axis. The common axis is also the same as the axis of the container body 100. The first, second, and third inner wall portions 14, 15, and 16 have one side (lower side) in the axial direction as an open end, and is connected to the inner closing plate portion 12 at the other end (upper side end). The first, second, and third inner wall portions 14, 15, and 16 have longer cylinder lengths in said order, and lower ends thereof terminate at lower levels in said order.

The first inner wall portion 14 is arranged inside the mouth portion of the container body 100. The third inner wall portion 16 covers the second inner wall portion 15 from the outside in the radial direction. A female screw 15*a* is formed on an inner peripheral surface of the second inner wall portion 15. The female screw 15*a* engages with a male screw formed on an outer peripheral surface of the mouth portion of the container body 100.

The inner closing plate portion 12 includes: an inner closing plate body 21 covering the upper sides of the inner wall portions 14, 15 and 16; and a nozzle 22 at the center of the inner closing plate body 21 as a passage port for contents in the container body 100.

The nozzle 22 has a tapered shape that protrudes from the inner peripheral portion of the inner closing plate body 21 to the opposite side (upper side) of the container body 100, and has a shape whose inner and outer diameters decrease toward the upper side. More specifically, the nozzle 22 has the shape of a funnel including a tapered nozzle body portion 23 and a cylindrical discharge port portion 24 protruding upward from a distal end portion of the nozzle body portion 23.

The inner closing plate body 21 is annular, more specifically, toroidal when viewed in a plan view. In addition, the inner closing plate body 21 includes a raised portion 26 in which a portion inside an outer peripheral portion of the surface of the inner closing plate body 21 is raised. When viewed from the top, an outer shape of the raised portion 26 fits to an open end portion of an outer wall portion 31, which will be described later, of the outer lid 4. The raised portion 26 includes two semi-circular portions 27 facing each other at opposite sides, one on the side with hinge 3 and the other one on the side away from the hinge 3, while two parallel linear portions 28 connecting the ends of the two semi-circular portions 27. Both the two semi-circular portions 27 have a shape that follows the circle which is the outer shape of the inner closing plate body 21. When the open end portion of the outer wall portion 31 is fitted to the raised portion 26, the outer wall portion 31 is placed on a portion of the inner closing plate body 21 located outside the raised portion 26 in the radial direction, that is, on the outer peripheral portion of the inner closing plate body 21. Note that the claw portion 13 protrudes upwardly from the surface of the raised portion 26. The claw portion 13 will be described in detail later.

In addition, an extension wall 29 extending from the inner wall portion 11 (third inner wall portion 16) to the other side in the axial direction is formed on the hinge 3 side of the inner closing plate body 21.

The outer lid 4 includes: the tubular outer wall portion 31; an outer closing plate portion 32 covering the tubular outer wall portion 31 to close the inside thereof; and a packing sheet support portion 33 on an inner surface of the outer closing plate portion 32, such that the packing sheet support portion 33 supports a packing sheet P, which will take a tight contact with a distal end of the nozzle 22; a plurality of convex portions 34, serving as mountains or protruding undercut portions on the inner surface of the outer wall portion 31; and a plurality of concave portions 35, serving as valleys or concaved areas between the plurality of convex portions 34 on the inner surface of the outer wall portion 31. The convex portions 34 and the concave portions 35 are aligned alternately in the direction parallel to the axial direction.

The outer closing plate portion 32 includes: an outer closing plate body portion 37 which closes one side of the tubular outer wall portion 31 in the axial direction; and a pedestal portion 38, which protrudes from an inner surface of the outer closing plate body portion 37, for placing the packing sheet P.

As shown in FIG. 1A, the pedestal portion 38 is formed in a "cross" shape when viewed from the top.

Note that the packing sheet P placed on the pedestal portion 38 has a disk shape, and is a circle having a diameter larger than a dimension of the cross of the pedestal portion 38 in a crossing direction. The packing sheet P is made of a resin that is softer than the hinge cap 1, and has elasticity enough soft to be slightly recessed when the distal end of the nozzle 22 is pressed, so as to ensure tight contact.

The packing sheet support portion 33 includes a pair of support arms 33*a* that hold the packing sheet P in between from opposite sides in a direction that intersects (more specifically, is orthogonal to) with the packing sheet P in the up-down direction.

The pair of support arms 33*a* protrude from an inner surface of the outer closing plate portion 32 and extend from the inner surface of the outer wall portion 31 to reach the periphery of the pedestal portion 38.

The support arm 33*a* includes: an arm portion body 33*b* that extends from the hinge 3 side toward the pedestal portion 38 on the inner surface of the outer wall portion 31; and a curved support portion body 33*c* that extends in a state of partially covering the periphery of the pedestal portion 38 from a distal end of the arm portion body 33*b* on the pedestal portion 38 side. When viewed from the top, the curved support portion body 33*c* is formed in an arc shape so as to follow an outer shape of the packing sheet P placed on the pedestal portion 38. In addition, a diameter of the arc formed inside the pair of support portion bodies 33*c* is formed to be slightly smaller than a diameter of the packing sheet P.

Figure 2:
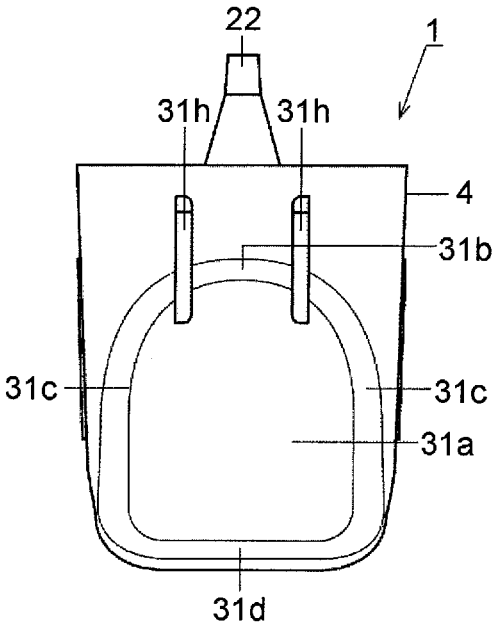
FIG. 2 is a side view of the hinge cap of FIG. 1B viewed from the right.

The outer wall portion 31 has a curved concave surface 31*a*, which is concaved in an arc shape when viewed from the side, on its outer surface on the side opposite to the hinge 3. The curved concave surface 31*a* is formed on the outer closing plate portion 32 side in the axial direction of the outer wall portion 31 to be easily touched by a finger during an operation of opening the outer lid 4. As shown in FIG. 2, the curved concave surface 31*a* includes a rounded upper edge 31*b*, left and right side edges 31*c* each extending linearly, and a lower edge 31*d* extending between the side edges 31*c*.

As shown in FIG. 1B, the outer wall portion 31 includes a recessed portion 31*v*, which is formed by a slope face slanted from the open end (upper end) of the outer wall portion 31 towards the other end, (lower end) at a position adjacent the hinge 3. A shape of the recessed portion 31*v* corresponds to the shape of the extension wall 29 of the inner lid 2. In addition, an end on the outer closing plate portion 32 side, which is a closed end (lower end) of the outer wall portion 31, is formed in a state of being inclined so as to be located on the one side (lower side) in the axial direction as proceeding from the hinge 3 side to the opposite side of the hinge 3.

The outer closing plate body portion 37 has a shape that is inclined so as to be directed to the one side in the axial direction of the outer wall portion 31 as proceeding from the hinge 3 side to the opposite side of the hinge 3 in accordance with the shape of the outer wall portion 31. In addition, the outer closing plate body portion 37 has a shape that extends to the opposite side of the hinge 3 as compared with a case where the outer wall portion 31 does not have the curved concave surface 31*a*, for example. An upper surface of the outer closing plate body portion 37 is inclined to be farther from the inner lid 2 as being separated from the hinge 3 with respect to a plane orthogonal to the axis of the outer lid 4, that is, the axis that coincides with the common axis in the closed state of the outer lid 4. The outer closing plate body portion 37 is provided with an eaves portion 31*e* on the opposite side of the side on which the hinge 3 is provided. The eaves portion 31*e* protrudes further outward from an outer tubular surface of the outer wall portion 31. This facilitates an operation of opening and closing the outer lid 4 in combination with the curved concave surface 31*a*.

The inner surface of the outer wall portion 31 is formed so as to be larger from the outer closing plate portion 32 side (lower side), which is the one side in the axial direction, to the open end side (upper side), which is the other side in the axial direction in consideration of easy removal of a convex-shaped portion of an injection-molding mold that forms the inner surface of the outer wall portion 31. That is, the inner surface of the outer wall portion 31 is widened outward in the radial direction as proceeding toward the open end (upward).

More specifically, the inner surface of the outer wall portion 31 is a tapered slope except for a part thereof, and is inclined by an angle θ with respect to the up-down direction. Such a part of the inner surface of the outer wall portion 31 is a portion of the inner surface of the outer wall portion 31 corresponding to the curved concave surface 31*a*, and includes a slope portion 31*g* that is inclined in a state of being slightly widened to the right side, which is the outer side in the radial direction, as proceeding upward from the outer closing plate portion 32, and a curved convex surface 31*f* that is curved in a state of being directed to the right side as proceeding upward from an upper end of the slope portion 31*g*. An angle of the slope portion 31*g* is smaller than the angle θ of the inner surface of the outer wall portion 31. The angle θ is preferably 0.2 to 20 degrees.

As shown in FIG. 2, the outer wall portion 31 is formed with a pair of through-holes 31*h* each penetrating in the radial direction at an interval in the circumferential direction. The pair of through-holes 31*h* are formed in a portion of the whole circumference corresponding to the curved concave surface 31*a*, in other words, on the opposite side of the hinge 3 in the circumferential direction. That is, the pair of through-holes 31*h* are elongated holes formed in the outer wall portion 31 and extending in parallel with the axis of the outer lid 4, extend to both sides of a plurality of convex portions 34*a* and 34*b*, which will be described later, and exist so as to sandwich the plurality of convex portions 34*a* and 34*b*. Further, the pair of through-holes 31*h* are formed in a range extending over a part of the curved concave surface 31*a*.

As shown in FIGS. 1A and 1B, the outer wall portion 31 includes a pair of grooves 31*s*, each extending from the open end (upper end) to reach the pair of through-holes 31*h*, on the inner surface. Since the groove 31*s* has a bottom and does not penetrate, the open end side of the outer wall portion 31 is an annular shape connected in the circumferential direction. In addition, the groove 31*s* and the through-hole 31*h* are connected in the axial direction (up-down direction) of the outer wall portion 31. The plurality of convex portions 34 and the plurality of concave portions 35 are arranged between the pair of grooves 31*s* and between the pair of through-holes 31*h* in the circumferential direction of the outer wall portion 31.

As shown in FIG. 10, the plurality of convex portions 34 and the plurality of concave portions 35 are arranged alternately side by side in the axial direction of the outer wall portion 31. The number of rows in which the convex portions 34 and the concave portions 35 are arranged side by side is one in the circumferential direction of the outer wall portion 31. The concave portion 35 is located closest to the open end side among the plurality of convex portions 34 and the plurality of concave portions 35.

The concave portion 35 is concaved with respect to the inner surface of the outer wall portion 31. The concave portion 35 is concaved in a stepped manner with respect to the circumferential direction of the outer wall portion 31. In addition, the number of the concave portions 35 is three in the present embodiment, which are from the open end side, the first concave portion 35*a*, the second concave portion 35*b*, and the third concave portion 35*c*, in FIG. 10. The reference sign with a number and an alphabet is used when referring to a particular concave portion, and the reference sign with only a number is used when referring to the concave portions in general.

The convex portion 34 protrudes from the inner surface of the outer wall portion 31, and forms the undercut portion in injection molding. In addition, the number of the convex portions 34 is two in the present embodiment, which are from the open end side, the first convex portion 34*a* and the second convex portion 34*b* in FIG. 10. The reference sign with a number and an alphabet is used when referring to a particular convex portion, and the reference sign with only a number is used when referring to the convex portions in general.

The concave portion 35*a* on the most open end side among the plurality of concave portions 35, that is, the first concave portion 35*a* from the open end side, is inclined in a state of being directed outward in the radial direction toward the open end. In addition, the convex portion 34*a* on the most open end side among the plurality of convex portions 34, that is, the first convex portion 34*a* from the open end side, and the concave portion 35*b* (that is, the second concave portion 35*b* from the open end side) adjacent to the first convex portion 34*a* on the inner side of the outer wall portion 31 form an engaging portion 41 that fits to a distal end portion of the claw portion 13 of the inner lid 2 in the closed state of the outer lid 4.

The claw portion 13 includes: a claw neck portion 13*a* protruding upward from the surface of the raised portion 26 of the inner closing plate portion 12 on the opposite side of the hinge 3; and a claw distal end portion 13*b* extending outwardly in the radial direction from an upper end portion of the claw neck portion 13*a*.

In addition, the convex portion 34*b* adjacent to the engaging portion 41 on the inner side of the outer wall portion 31 is the second convex portion 34*b* from the open end side. The concave portion 35*c* adjacent to the adjacent convex portion 34*b* on the inner side of the outer wall portion 31 is the third concave portion 35*c* from the open end side. The second convex portion 34*b* from the open end side and the third concave portion 35*c* from the open end side each have a shape similar to that of the engaging portion 41, and form a mold pressing portion 43 that does not fit to the distal end portion of the claw portion 13 in the closed state of the outer lid 4. In addition, the mold pressing portion 43 is adjacent to the engaging portion 41 on the inner side of the outer wall portion 31. Note that there is only the first concave portion 35*a* on the open end side of the outer wall portion 31 with respect to the engaging portion 41, and thus, the mold pressing portion 43 is formed only on the inner side of the outer wall portion 31 with respect to the engaging portion 41 in the present embodiment. The engaging portion 41 and the claw portion 13 constitute an engaging mechanism.

Figure 1C:
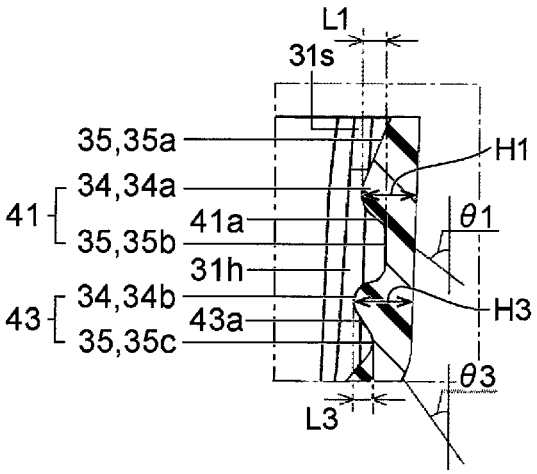
Figure 4A:
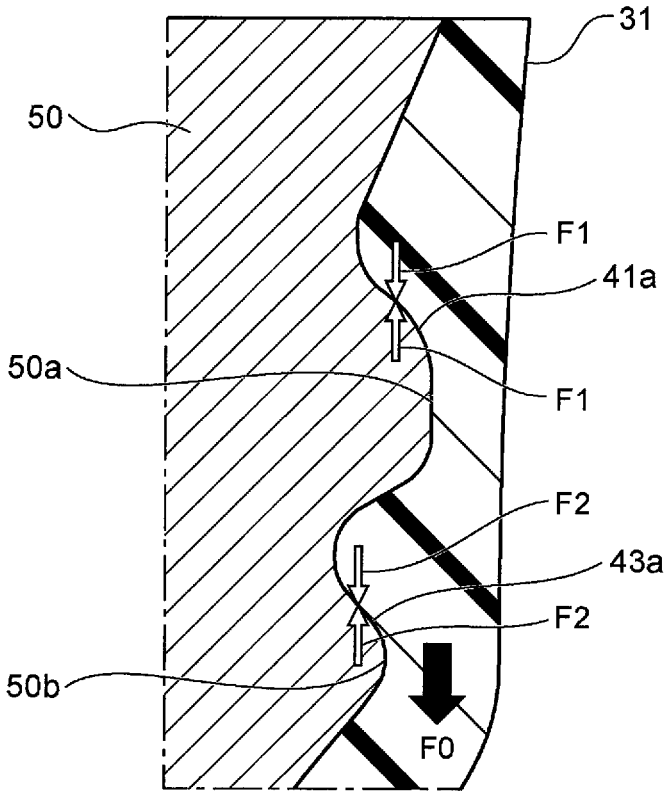
FIG. 4A is a cross-sectional view showing an initial state when an outer wall portion is to be forcibly removed from a mold.

In FIG. 10, a protrusion amount L3 of the convex portion 34*b* with respect to the concave portion 35*c* of the mold pressing portion 43 is smaller than a protrusion amount L1 of the convex portion 34*a* with respect to the concave portion 35*b* in the engaging portion 41 in the present embodiment. Thus, a resistance force received from a mold 50 is smaller in the convex portion 34*a* than in the convex portion 34*b* when forcibly removing the mold 50 as shown in FIG. 4A, and thus, any damages received from the resistance force is smaller in the convex portion 34*a* than in the convex portion 34*b*. In addition, a height H3 of the convex portion 34*b* from an outer peripheral surface of the outer wall portion 31 is larger than a height H1 of the convex portion 34*a*. Further, a wall thickness (H1−L1) of the outer wall portion 31 between the convex portion 34*a* and the convex portion 34*b* is thinner than a wall thickness (H3−L3) on the lower side (opposite side of the convex portion 34*a*) from the convex portion 34*b*. Thus, the portion with the wall thickness (H1−L1) can be easily bent than the portion with the wall thickness (H3−L3), as clear from FIG. 1C. Thus, the resistance force received from the mold 50 can be released by bending at the wall thickness (H1−L1) portion when the mold 50 is forcibly removed as shown in FIG. 4A. Further, the outer wall portion 31 facing the convex portion 34*a* is partially not existing due to the recessed portion 31*v*. Thus, the mold 50 can be easily inclined with respect to the outer wall portion 31 toward the recessed portion 31*v* during the removal of the mold 50 forcibly.

An engaging slope 41*a* and a pressing slope 43*a*, each is slanted with respect to the axial direction of the outer wall portion 31, are formed on the inner side of each of the convex portion 34*a* of the engaging portion 41 and the convex portion 34*b* of the mold pressing portion 43, respectively. Both the engaging slope 41*a* and the pressing slope 43*a* are slanted inwardly in the radial direction from the inner side of the outer wall portion 31 to the open end side. In addition, an angle θ3, which is an acute angle formed by the pressing slope 43*a* and a straight line in the axial direction, is smaller than an angle θ1 which is an acute angle formed by the engaging slope 41*a* and a straight line parallel to the axial direction in the present embodiment. Thus, the pressing slope 43*a* is more easy to slip than the engaging slope 41*a* with respect to the mold 50 when the mold 50 is forcibly removed.

Note that the engaging portion 41 and the mold pressing portion 43 are arranged on the front side, which is the opposite side of the hinge side where the hinge 3 is located, in the circumferential direction of the outer wall portion 31. Furthermore, portions 41 and 43 are arranged between the pair of grooves 31*s*, and also between the pair of through-holes 31*h*. In addition, the engaging portion 41 and the mold pressing portion 43 are arranged in the axial direction of the outer lid 4 to form a single row, and the row exists only one when viewed in the circumferential direction.

Figure 4B:
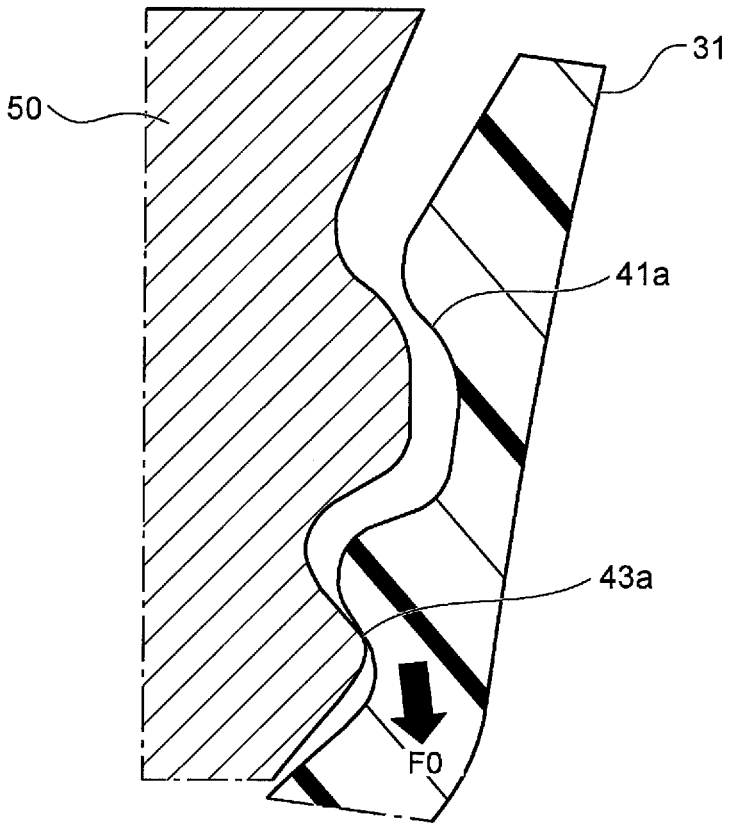
FIG. 4B is a cross-sectional view showing a state immediately after the outer wall portion is forcibly pulled from the mold for separation.

A reason why the mold pressing portion 43 is provided will be described with reference to FIGS. 4A and 4B. FIG. 4A shows a state in which the outer wall portion 31 and the mold 50 are tightly attached, and the mold 50 is about to be forcibly removed from the outer wall portion 31 by an external force F0. FIG. 4B shows a state immediately after the forcible removal starts and the outer wall portion 31 is released from the mold 50. As shown in FIG. 4A, the external force F0 is dispersed into action and reaction forces F1 and F2 generated at the slope 41*a* and the slope 43*a*, where the plurality of undercut portions exist. At the places where the slope 41*a* and the slope 43*a* face the corresponding surfaces of the mold 50, sliding forces are generated at such slopes. With the dispersion into the forces F1 and F2, a mold release resistance is dispersed, and any damages to the engaging slope 41*a* can be mitigated/prevented. Further, when the outer wall portion 31 is separated from the mold 50 as shown in FIG. 4B, the recessed portion 31*v* is formed on the hinge side, which is the opposite side of the front side (the side where the engaging portion 41 and the mold pressing portion 43 exist) where the slope 41*a* and the slope 43*a* of the outer wall portion 31 are provided, and thus, the mold 50 can escape while being tilted toward the hinge side, only the pressing slope 43*a* is in contact with the mold 50, the engaging slope 41*a* can be kept in the state of being separated from the mold 50, and the engaging slope 41*a* will not be damaged. Even if the engaging slope 41*a* is in contact with the mold 50 immediately after the outer wall portion 31 being separated from the mold 50, the engaging slope 41*a* can be prevented from being damaged by bending, because the wall thickness of the outer wall portion 31 between the convex portion 34*a* and the convex portion 34*b* is thin.

Next, the hinge 3 will be described. The hinge 3 is joined to the outer wall portion 31 of the outer lid 4 and the inner wall portion 11 (third inner wall portion 16) of the inner lid 2, and includes: a first wing 3*a* protruding outward in the radial direction from the outer wall portion 31; a second wing 3*b* protruding outward in the radial direction from the inner lid 2; and a portion that is joined to the first wing 3*a* and the second wing 3*b* and is thinner than both the first wing 3*a* and the second wing 3*b*, that is, a hinge body 3*c* which is a rotation axis portion. The hinge body 3*c* is the center when the outer lid 4 is opened (performs an axis of rotating motion), and thus, is also called the hinge rotation axis 3*c*. The elastic plate 5 is located between the pair of hinged wings 3. In the closed state of the outer lid 4, as shown in FIG. 3, the hinge rotation axis 3*c* is at a level above an upper surface of the inner closing plate portion 12. As a result, the upper surface of the inner closing plate portion 12 and a lower surface of the outer wall portion 31 can abut on each other reliably and stably as compared with a case where the hinge rotation axis 3*c* is included on the same level as the upper surface of the inner closing plate portion 12.

The elastic plate 5 has a plate shape and functions as a so-called leaf spring. The elastic plate 5 has a cross-sectional shape that is bent in a V shape, and has opposite ends joined, respectively, to the outer wall portion 31 of the outer lid 4 and the inner wall portion 11 of the inner lid 2. More specifically, the elastic plate 5 includes a first pivotable portion (connected to the inner lid 2 side) 5*a* that is freely bendable, a leaf spring portion 5*c* that has a configuration of a V shape, and a second pivotable portion (connected to the outer lid 4 side) 5*b* that is freely bendable. The first pivotable portion 5*a* and the second pivotable portion 5*b* are thinner than the leaf spring portion 5*c*. That is, the thickness of the elastic plate 5 has a tapered thickness that is the thickest in the central portion (leaf spring portion 5*c*) and becomes thinner toward the first and second pivotable portions 5*a* and 5*b*. A spring effect is stronger than a plate that has a uniform thickness. Both the first pivotable portion 5*a* and the second pivotable portion 5*b* are located away from the hinge rotation axis 3*c*. In the open state of the outer lid 4 as shown in FIGS. 1B and 1*n* the closed state of the outer lid 4 as shown in FIG. 3, the V-shaped leaf spring portion 5 takes such a state that both ends 5*a* and 5*b* are spaced but at a closest possible distance, at which the V-shaped leaf spring portion 5 is in a stable state. As the outer lid 4 rotates about the hinge rotation axis 3*c* by about 180 degrees from the open state (FIG. 1B) to the closed state (FIG. 3) or vice versa, the second pivotable portion 5*b* takes a motion of a semi-circle indicated by the dotted line in FIG. 1B. In a state where the outer lid 4 is rotated about 90 degrees, i.e., a halfway, the V-shaped leaf spring portion 5 opens to take such a state that both ends 5*a* and 5*b* are spaced apart at a furthest possible distance producing a biasing force acting towards the closing/opening direction. When the outer lid 4 passes through a position rotated 90 degrees while operating in the closing direction, the biasing force in the closing direction is applied automatically to complete the closing operation. When the outer lid 4 passes through a position rotated 90 degrees while operating in an opening direction, the biasing force in the opening direction is applied automatically to complete the opening operation. Therefore, the outer lid 4 can be held in the open state or the closed state. The V-shaped leaf spring portion 5 applies snap action to the outer lid 4 in both the opening direction and the closing direction. As a result, the outer lid 4 can be comfortably opened and closed. The above-described engaging mechanism is provided in order to hold the outer lid 4 in the closed state more firmly.

In the hinge cap 1 of the first embodiment of the present invention, the two convex portions 34 as the undercut portions are arranged side by side in a straight line in the axial direction of the tubular outer wall portion 31. Thus, the mold release resistance when the outer wall portion 31 is released from the portion of the injection-molding mold that forms the inner surface of the outer wall portion 31 is dispersed to the plurality of undercut portions. For example, in comparison with a case where a hinge cap has only one convex portion as an undercut portion on the outer wall portion 31, it is possible to design the shape of the engaging portion 41 freely and nearly the same as a preferred shape as designed. Also, an engaging state between the engaging portion 41 and the claw portion 13 can be made very stable. Moreover, the concave portion 35*b* of the engaging portion 41 has the shape that is concaved with respect to the inner surface of the outer wall portion 31, and thus, the claw portion 13 is positioned in the circumferential direction with respect to the concave portion 35*b* of the engaging portion 41 in the closed state of the outer lid 4. Thus, the engaging state between the engaging portion 41 and the claw portion 13 is stable.

In the hinge cap 1 of the first embodiment of the present invention, the engaging portion 41 includes the convex portion 34*a* on the most open end side among the plurality of convex portions 34, and thus, the claw portion 13 does not have to get over another convex portion during the opening/closing operation of the outer lid 4 so that the opening/closing operation becomes smooth.

In the hinge cap 1 of the first embodiment of the present invention, there is only one row formed by the concave portions 35 and the convex portions 34 of the engaging portion 41 and the mold pressing portion 43 along the circumferential direction of the outer wall portion 31. Thus, the outer lid 4 can be easily opened and closed and the mold can be easily removed during injection molding as compared with a case where there are a plurality of the rows. Moreover, the row is formed on the opposite side of the hinge 3, and thus, the closed state of the outer lid 4 is more stable than that in a case where the row is formed in the vicinity of the hinge 3.

In the hinge cap 1 of the first embodiment of the present invention, the through-holes 31*h* are formed on both sides of the outer wall portion 31 along the circumferential direction with respect to the engaging portion 41. A portion between the through-holes 31*h* in the outer wall portion 31 can be easily deformed. Thus, the opening/closing operation of the outer lid 4 becomes easy. Also, the shape of the outer lid 4 does not change regardless of the presence or absence of the through-hole 31*h*, unless external force is applied. Thus, the engaging state between the claw portion 13 and the engaging portion 41 is stable. That is, since the through-holes 31*h* are formed on both sides of a row of the engaging portion 41 and the mold pressing portion 43 aligned in the axial direction, the row of the engaging portion 41 and the mold pressing portion 43 can be easily displaced outward in the radial direction. Thus, engaging portion 41 can be easily pressed by the claw portion 13.

In the hinge cap 1 of the first embodiment of the present invention, the through-hole 31*h* is the elongated hole extending in the axial direction of the outer wall portion 31, and thus, the opening/closing operation of the outer lid 4 becomes easier depending on the length of the through-hole 31*h*, and the mold release resistance during injection molding also becomes smaller. Moreover, since the through-holes 31*h* as the elongated holes are arranged not only in the engaging portion 41 but also on both the sides of the mold pressing portion 43 in the circumferential direction, the opening/closing operation of the outer lid 4 becomes easy and the mold release resistance becomes small.

The hinge cap 1 of the first embodiment of the present invention is provided with the groove 31*s* extending from the open end to the through-hole 31*h* in the inner surface of the outer wall portion 31, but provided with no cutout portion along the circumferential direction in the open end portion side of the outer wall portion 31. Thus, the engaging state between the claw portion 13 and the engaging portion 41 is stable even when external force is applied to the outer lid 4.

The hinge cap 1 of the first embodiment of the present invention is provided with the raised portion 26 which is raised from the surface of the inner closing plate portion 12 and is fitted to the open end portion of the outer wall portion 31, and thus, the closed state of the outer lid 4 is stable.

In the hinge cap set of the first embodiment of the present invention, the shape of the engaging portion 41 can be brought closer to the shape as designed by the plurality of undercut portions (convex portions 34) configured to disperse the mold release resistance, and thus, the engaging state between the claw portion 13 and the engaging portion 41 can be held even if the packing sheet P has restoring force, and the airtightness is improved by the close contact between the packing sheet P and the nozzle 22.

The present invention is not limited to the above embodiment, and can be appropriately modified within a scope not departing from the spirit thereof. For example, the number of the mold pressing portions 43 is one in the above embodiment, but may be plural without being limited thereto in the present invention.

In addition, as compared with the protrusion amount L1 of the convex portion 34 with respect to the concave portion 35 of the engaging portion 41, the protrusion amount L3 of the convex portion 34 with respect to the concave portion 35 of the mold pressing portion 43 is smaller in the above embodiment, but may be desirably equal to or more than, or more desirably larger without being limited thereto in the present invention. As a result, the surface of the engaging portion 41 can be prevented from being damaged as much as possible at the time of mold release, and the engaging state between the engaging portion 41 and the claw portion 13 can be stabilized.

In addition, as compared with the angle θ1 which is the acute angle formed by the engaging slope 41*a* and the straight line parallel to the axial direction, the angle θ3, which is the acute angle formed by the pressing slope 43*a* and the straight line parallel to the axial direction, is smaller in the above embodiment, but may be desirably the same, or more desirably larger without being limited thereto in the present invention. As a result, the surface of the engaging portion 41 can be prevented from being damaged as much as possible at the time of mold release, and the engaging state between the engaging portion 41 and the claw portion 13 can be stabilized.

Since the mold pressing portion 43 is provided in order to disperse the mold release resistance as described above, the mold release resistance applied to the mold pressing portion 43 increases as the angle θ3 becomes larger, and the damage to the surface of the engaging portion 41 can be mitigated. As for the angle θ1 of the engaging portion 41, the engaging with the claw portion 13 is stronger as the angle is larger, and a click feeling is improved, for example, but the surface of the engaging portion 41 is easily damaged because the resistance at the time of mold release increases. In addition, the mold release resistance itself between the mold 50 and a molded product increases as the angles θ1 and 83 become larger. Thus, it is necessary to appropriately adjust the respective angles in accordance with the shape of the outer wall portion 31, which is the molded product, in order to smoothly release the mold 50 from the molded product. It is desirable that an apex 50*b* of the mold 50 (facing the concave portion 35*c*) be equal to or lower than an apex 50*a* of the mold 50 (facing the concave portion 35*b*) when viewed from a central axis of the mold. As a result, the contact of the mold 50 with the engaging slope 41*a* other than the pressing slope 43*a* at the time of releasing the mold 50 is reduced (see FIG. 4B), and the damage to the surface of the engaging portion 41 can be prevented. A height of the apex 50*b* is preferably equal to or lower by 0.01 mm than that of the apex 50*a*, and more preferably lower by 0.02 to 2 mm than that of the apex 50*a*.

According to a modification, the hinge cap can be used in a syringe, such as disclosed in Japan Patent Publication No. 2006-61739 which is herein incorporated by reference. In the case of syringe, the nozzle 22, pedestal portion 38, packing sheet P, packing sheet support portion 33 are not provided, and thus they can be eliminated. Also, the inner lid 2 is not provided, and the claw portion (13) is provided directly to a body 100 which can be the syringe cylinder.

What is claimed is:

1. A hinge cap formed by an injection-molding comprising:

an inner lid capable of being attached to a container body;

a hinge; and an outer lid that is connected to the inner lid by the hinge to open and close the cap, wherein the inner lid includes:

a tubular inner wall portion capable of being attached to a mouth portion of the container body;

an inner closing plate portion which protrudes from an inner surface of the inner wall portion for closing one side of the inner wall portion and is formed with a passage port; and a claw portion protruding outwardly in a radial direction from a surface of the inner closing plate portion, the outer lid includes:

a tubular outer wall portion;

an outer closing plate portion for closing a first axial end of the outer wall portion; and a plurality of convex portions as undercut portions and a plurality of concave portions which are aligned alternately in an axial direction of the tubular outer wall portion on an inner surface of the outer wall portion, the pluralities of convex portions and concave portions are arranged such that a first convex portion and a first concave portion adjacent to the first convex portion form an engaging portion capable of being engaged with the claw portion in a closed state of the outer lid, a second convex portion adjacent to the engaging portion and a second concave portion adjacent to the second convex portion form a mold pressing portion, and the outer wall portion has through-holes formed on both sides of the engaging portion.

2. The hinge cap according to claim 1, wherein a second axial end of the outer wall portion has an opening, and the first convex portion of the engaging portion is closest to the opening among the plurality of convex portions.

3. The hinge cap according to claim 1, wherein the first and second concave portions and the first and second convex portions are aligned in a single row in the axial direction of the outer wall portion, and are formed on an opposite side of the outer wall portion relative to the hinge.

4. The hinge cap according to claim 1, wherein each of the through-holes is an elongated hole extending in the axial direction of the outer wall portion.

5. A hinge cap set comprising:

the hinge cap according to claim 1; and a packing sheet that enhances airtightness in a closed state of the hinge cap, wherein the inner closing plate portion includes:

an inner closing plate body connected to the inner wall portion; and a nozzle protruding from the inner closing plate body, the outer lid includes a packing sheet support portion, and the packing sheet has elasticity to provide tight contact with a distal end of the nozzle.

6. A hinge cap with a body formed by an injection-molding comprising:

a body having an open end with a claw portion provided on a rim of the open end;

a hinge provided on the rim at a position opposite to the claw portion; and a lid connected to the body through the hinge to open and close the open end of the body, wherein the lid includes:

a tubular outer wall portion;

an outer closing plate portion for closing one side of the outer wall portion; and a plurality of convex portions as undercut portions and a plurality of concave portions which are aligned alternately in an axial direction of the tubular outer wall portion on an inner surface of the outer wall portion, the pluralities of convex portions and concave portions are arranged such that a first convex portion and a first concave portion adjacent to the first convex portion form an engaging portion capable of being engaged with the claw portion in a closed state of the lid, a second convex portion adjacent to the engaging portion and a second concave portion adjacent to the second convex portion form a mold pressing portion, and the outer wall portion has through-holes formed on both sides of the engaging portion.

* * * * *